US006332494B1

(12) United States Patent
Bodas et al.

(10) Patent No.: US 6,332,494 B1
(45) Date of Patent: Dec. 25, 2001

(54) AIR-COOLED CONDENSER

(75) Inventors: Janos Bodas; Gabor Csaba, both of Budapest (HU)

(73) Assignee: Energiagazdalkodasi Reszvenytarsasag, Budapest (HU)

( * ) Notice: Subject to any disclaimer, the term of this patent is extended or adjusted under 35 U.S.C. 154(b) by 0 days.

(21) Appl. No.: 09/509,769

(22) PCT Filed: Oct. 14, 1998

(86) PCT No.: PCT/HU98/00092

§ 371 Date: Mar. 31, 2000

§ 102(e) Date: Mar. 31, 2000

(87) PCT Pub. No.: WO99/20967

PCT Pub. Date: Apr. 29, 1999

(30) Foreign Application Priority Data

Oct. 16, 1997 (HU) ..... 97 01654

(51) Int. Cl.[7] ..... F28B 3/00
(52) U.S. Cl. ..... 165/112; 165/111; 165/183
(58) Field of Search ..... 165/111, 112, 165/113, 913, 183

(56) References Cited

U.S. PATENT DOCUMENTS

| | | | | |
|---|---|---|---|---|
| 3,229,722 | | 1/1966 | Kritzer . | |
| 3,556,204 | | 1/1971 | Dehne . | |
| 3,612,172 | | 10/1971 | Dohnt . | |
| 3,710,854 | | 1/1973 | Staub . | |
| 3,880,231 | * | 4/1975 | Gauthier | 165/166 |
| 4,190,102 | * | 2/1980 | Grez | 165/113 |
| 4,815,296 | | 3/1989 | Amir . | |
| 4,909,309 | | 3/1990 | Pálfalvi et al. . | |
| 5,275,233 | | 1/1994 | Little . | |
| 5,323,851 | | 6/1994 | Abraham . | |
| 5,632,329 | * | 5/1997 | Fay | 165/113 |
| 5,653,281 | * | 8/1997 | Berg et al. | 165/113 |
| 5,765,629 | * | 6/1998 | Goldsmith et al. | 165/112 |
| 6,142,223 | * | 11/2000 | Bodas et al. | 165/183 |

FOREIGN PATENT DOCUMENTS

| | | |
|---|---|---|
| 78 12 373 | 3/1979 | (DE) . |
| 0 617 250 A2 | 9/1994 | (EP) . |
| 0 780 652 A2 | 6/1997 | (EP) . |
| 2 017 894 A | 10/1979 | (GB) . |
| WO 98/33028 | 7/1998 | (WO) . |

* cited by examiner

*Primary Examiner*—Ira S. Lazarus
*Assistant Examiner*—Terrell McKinnon
(74) *Attorney, Agent, or Firm*—Dickinson Wright PLLC

(57) ABSTRACT

An air-cooled condenser includes an upper header for distributing a vaporous medium to be condensed, a lower header for collecting condensate, spaced finned tubes with outer fins, the finned tubes being connected in parallel between the upper header and the lower header and cooled by a cooling air flow, means for draining the condensate form the lower header and extraction means for removing non-condensible gases from the condenser. The lower header is also used for distributing the vaporous medium to the finned tubes, so that the vaporous medium id fed into the finned tubes through both the upper and lower headers, and the extraction means are connected to each of the finned tubes at its portion facing the cooling air flow.

20 Claims, 11 Drawing Sheets

AIR-COOLED CONDENSER

TECHNICAL FIELD

The invention relates to an air-cooled condenser for condensing a vaporous medium, preferably steam, the condenser comprising an upper header for distributing the vaporous medium, a lower header for collecting condensate, spaced finned tubes with outer fins, said finned tubes being connected in parallel between the upper header and the lower header and cooled by a cooling air flow, means for draining the condensate from the lower header and extraction means for removing non-condensible gases from the condenser.

BACKGROUND ART

Condensers are widely used in the manufacturing, chemical and energy industry. The direct system air-cooled condenser is a special type of condensers, which generally operates under vacuum and without cooling liquid, i.e. the vaporous medium is condensed directly by means of a cooling air flow.

The air-cooled condensers usually consist of a number of finned tubes connected in parallel between an upper header and a lower header. Inside the finned tubes, vaporous medium, preferably steam flows in the direction of the lower header and the cooling air flows outside the finned tubes approximately perpendicularly to them. On the outer side of the finned tubes, in order to compensate the low heat transfer coefficient of the air, fins are formed for increasing the air side surface. The steam in the finned tubes is condensed by the cooling air flow, the condensate is collected by means of gravitation in the lower header, and it is drained and taken back to the process circuit usually by a pump. Since the air-cooled condensers operate under vacuum, air must be removed from the condenser when starting up.

It is well known that not only pure steam enters the finned tubes but also a very low quantity of non-condensible gases, mainly air. One part of the non-condensible gases is carried by the steam, while the larger part is getting into the steam as a result of the leaks of the process circuit. An example for the possible leak is the dividing plane of the steam turbine. This air quantity—since the air is a non-condensible gas—is concentrated in the finned tubes of the condenser and deteriorates the efficiency of the heat transfer, i.e. at a given temperature difference less heat is transferred. Therefore, the air must be removed continuously, which is usually carried out by a continuously running vacuum pump.

It is also known that the steam being condensed in the finned tubes moves continuously in a gradually decreasing quantity, and there is at least one point in the finned tubes where the velocity of the steam is zero. This at least one point is called congestion point. The congestion point is characterised in that the steam flows to it from all directions, but steam does not move away from it in any direction. The place of this congestion point depends on many factors, primarily on the geometry of the heat exchanger, on the velocity and temperature distribution of the cooling air flow, etc.

If the steam includes non-condensible gases, primarily air, in a very small quantity, for example approximately 0.01% in relation to the steam quantity, the air will be travelling exactly towards the congestion point described above. To make sure that air is not being concentrated at this point, thus to avoid the formation of the so-called air pocket, it must be removed continuously, i.e. the congestion point has to be displaced outside the finned tube. If this is not done, the following consequences have to be faced.

The air pocket expands gradually, thereby reducing the steam-side heat transfer coefficient.

It decreases the effective inner surface of the finned tube by blocking the internal surface from the condensing steam.

In cold weather it would result in the undercooling of the surface of the finned tube, which could cause freezing up of it.

Finally, with the increasing partial pressure of the air, the air pocket would reduce the temperature of condensation and thereby the temperature difference between the two sides of the heat exchanger, i.e. the driving force of the heat exchange.

The most suitable place for removing the air from the finned tubes is exactly the congestion point mentioned above. This would be simple if the place of the congestion point were constant in the finned tubes. Unfortunately, this is not the case, because this place could be different under various operating conditions. In addition, not only the change in operating conditions, but also the inevitable flow asymmetry would also make the place of the congestion point uncertain. To make sure that under all operating conditions and in all finned tubes the congestion point is at a determined place outside the finned tubes, a geometrical design must be implemented where the velocity and direction of the steam flow are determined and sufficiently high in the vicinity of air extraction. A general solution may not be identified, and a different approach is to be applied for each heat exchanger geometry.

It is obvious from the discussion above that through the air extraction, not only air but steam must also be extracted, because only in this way can it be ensured that the steam velocity is appropriate everywhere, i.e. that an air pocket is not developed at any point. One known solution is to introduce a large part of the steam quantity into the air extraction. The disadvantage in this case is that a significant heat quantity has to be removed from the steam-air mixture. Instead, another known solution is generally chosen according to which an after-cooler is connected after the so-called main condenser.

The after-cooler condenses a relatively large, generally 15 to 25% part of the steam, thereby ensuring the appropriate velocity and the determined flow directions at the air extraction. To make sure that the undercooling of the condensate is not excessive which is to be avoided from the aspect of efficiency and frost risk, the after-cooler is usually connected in counterflow, i.e. the condensate flows down on the wall of the after-cooler in an opposite direction to the steam flowing upwards with gradually increasing air concentration. At the end of the after-cooler, where most of the steam has already been condensed, the concentrated air-steam mixture is extracted usually by a vacuum pump.

In the case when there is more than one row of finned tubes in the direction of the cooling air flow, or there is only one row of finned tubes but they are divided into separate internal channels by separation walls, the first finned tube/channel row receives colder cooling air than the next rows in the direction of the cooling air flow, therefore it condenses the entering steam along a shorter path than the other finned tubes/channels. Therefore, a congestion point will be developing therein towards which steam from the other finned tubes/channels will flow upwards via the lower header. The same can be the case for the second etc. finned tube/channel rows, wherein the distance between the congestion points and the upper header in the successive finned tube/channel rows is gradually increasing. In case when there is air in the steam, it flows in the direction of the congestion point(s) mentioned above and after a while it fills the section(s)

below the congestion point(s). This air pockets, as mentioned above, may result in the freezing up of the finned tubes in cold weather.

To eliminate these air pockets, according to a known solution, the congestion points are displaced in a way that a steam quantity sufficient to shift the congestion points in the first finned tube/channel to the lower header is removed through an extraction pipe connected to the lower header. This can be assumed like cutting across the heat exchanger at the congestion point in the first finned tube/channel, and the above quantity of the steam is transferred to an after-cooler. Such an air-cooled condenser is described in DE GM 78 12 373, according to which a separate after-cooler connected in series to the condenser is provided. This solution has several disadvantages. First of all, a separate after-cooler is to be designed. Secondly, the friction loss of the cooling system will be increased for two reasons. One is that the path to be travelled by the steam is longer. The steam flowing at a high velocity suffers higher pressure loss in the finned tubes, and as a consequence, along the finned tubes the temperature of the steam will be reduced, and so is the temperature difference between the steam and the cooling air, which difference is proportional to the efficiency of the heat exchanger. The other is that the heat exchanger surface reserved for the after-cooler connected in series to the condenser reduces the heat exchanger surface of the condenser, thereby reducing the steam entrance cross section.

This latter disadvantage can be avoided by a known solution described in WO 98/33028. According to this solution an air-cooled condenser having so-called integrated multichannel finned tubes is provided, which finned tubes can be produced by, for example, extrusion. The fins on the outer side of the finned tubes can be made from the tubes by machining or can be fixed by welding or soldering on the extruded tubes. The after-cooler is integrated into or separated from the multi-channel tubes in a way that in the appropriate channels in the vicinity of each already described congestion point, a closure element is arranged. Adjacent the closure elements there are breakthroughs formed in the separation walls of the channels, which direct the steam into neighboring channels. The breakthroughs also ensure that the condensate developed above the air pockets is drained into the lower header. The separation walls separating the after-cooler from the condenser section do not have any breakthroughs, and this guarantees the determined flow direction of the steam-air mixture towards an air extraction. In the separation walls of the after-cooler and in that of the condenser there are further breakthroughs for allowing free flow of the steam between their neighbouring channels. The advantage of this structure is that the integrated after-cooler does not decrease the incoming steam entrance cross section of the finned tubes, so the steam-side pressure drop is decreased. On the other hand, the path to be travelled by the steam is relatively long, and this is detrimental to the efficiency of the heat transfer.

DISCLOSURE OF INVENTION

The main object of the invention is to provide an air-cooled condenser in which the inlet cross-section for the vaporous medium is as large as possible, in which even with a limited total finned tube cross section the steam-side pressure drop is relatively small, thereby making the temperature difference and the efficiency of the air-cooled condenser as high as possible, and from which the non-condensible gases are safely extracted.

Furthermore, it is also an object of the invention to provide an air-cooled condenser which is simple and cost efficient, and from which the condensate is safely drained.

Thus, the invention is an air-cooled condenser comprising an upper header for distributing a vaporous medium to be condensed, a lower header for collecting condensate, spaced finned tubes with outer fins, said finned tubes being connected in parallel between the upper header and the lower header and cooled by a cooling air flow, means for draining the condensate from the lower header and extraction means for removing non-condensible gases from the condenser. According to the invention, the lower header is also used for distributing the vaporous medium to the finned tubes, so that the vaporous medium is fed into the finned tubes through both the upper and lower headers, and the extraction means are connected to each of the finned tubes at its portion facing the cooling air flow.

The larger inlet cross section available to the vaporous medium and the shorter path to be travelled by the vaporous medium reduces the pressure drop in the finned tubes, and so the temperature difference and thus the efficiency of the heat exchanger will be the highest possible. The high efficiency makes it possible to design a condenser with less heat exchange surface. In this way an air-cooled condenser is provided which is more simple and cost efficient than prior art air-cooled condensers.

The air-cooled condenser according to the invention also ensures that the temperature of the condensate collected in the lower header is identical with the saturation temperature associated with the pressure of the entering vaporous medium, that is there is no undercooling. This is advantageous because for pre-heating the higher temperature condensate less steam must be taken away from the steam turbine, which results in an efficiency improvement of the process circuit.

A preferred embodiment of the invention comprises finned tubes each having two substantially flat side walls arranged generally in parallel to the cooling air flow, a first closing surface facing the cooling air flow and a second opposite closing surface, the side walls being connected by the first and second closing surfaces, wherein said extraction means comprise at least one extraction pipe for each finned tube connected to the finned tube at the first closing surface. The closing surfaces of the finned tubes are preferably arched. This kind of finned tubes can be advantageously used in an air-cooled condenser according to the invention.

In another preferred embodiment each of the finned tubes has at least one longitudinal separation wall connected to the side walls and dividing the inner space of the finned tube into longitudinal parallel channels, and in said at least one separation wall there are breakthroughs for allowing the flow of the medium between neighbouring channels. The separation walls improve the ability of the finned tubes to withstand the pressure difference between outside and inside of the finned tubes and to carry the fins. The breakthroughs are formed substantially equally spaced in said at least one separation wall.

Preferably, the air-cooled condenser comprises finned tubes each designed substantially symmetrically to a median plane bisecting the finned tubes perpendicularly to the side walls, wherein one extraction pipe is connected to each of the finned tubes substantially at the median plane. In this way simple and cost efficient finned tubes are provided.

In another preferred embodiment each of the finned tubes has a separated after-cooler formed in a first channel in the direction of the air flow, the after-cooler being separated by a closure element arranged at an end of the first channel and by an adjoining continuous portion of a separation wall of the first channel from remaining parts of the finned tube, wherein one extraction pipe is connected to each of the first channels in the vicinity of said closure element. The closure element is arranged preferably at the upper end of the first channel, or at the lower end of the first channel, in which case between the extraction pipe and the closure element there is a drain pipe for draining condensate from the after-cooler.

According to another preferred embodiment the air-cooled condenser has a first part fitted with finned tubes each designed substantially symmetrically to a median plane bisecting the finned tubes perpendicularly to the side walls, and a second part fitted with finned tubes each having a separated after-cooler formed in a first channel in the direction of the air flow, the after-cooler being separated by a closure element arranged at an end of the first channel and by an adjoining continuous portion of a separation wall of the first channel from remaining parts of the finned tube, wherein in the first part one extraction pipe is connected to each of the finned tubes substantially at the median plane, in the second part one extraction pipe is connected to each of the first channels in the vicinity of said closure element, and the extraction pipes in the first part are connected via a common transfer pipe to each of the first channels of the finned tubes in the second part substantially at middle portions of the first channels. By means of this combination of finned tubes a very efficient air extraction can be provided.

In a further preferred embodiment each of the finned tubes has multiple separation walls, wherein each of the finned tubes is divided by closure elements formed in the channels and by further breakthroughs formed in the separation walls adjacent the closure elements into a main condenser and at least one after-cooler conducting the medium from the main condenser to the at least one extraction pipe.

Preferably, there are one after-cooler and one extraction pipe in each of the finned tubes, wherein each of the closure elements is disposed in a distance from the upper header so that said distance successively increases starting from a first channel in the direction of the cooling air flow towards the interior of the finned tube, the breakthroughs adjacent the closure elements directs the medium into a neighbouring channel, and the extraction pipe is connected to a section of the first channel between its closure element and the lower header in the vicinity of said closure element. Preferably, starting from the first channel about half of the channels are provided with said closure elements.

In another preferred embodiment there are a pair of symmetrical arranged after-coolers and two corresponding extraction pipes in each of the finned tubes, wherein pairs of the closure elements are disposed symmetrically to and in a distance from a median plane of the finned tube so that said distance successively decreases starting from a first channel in the direction of the cooling air flow towards the interior of the finned tube, the breakthroughs adjacent the closure elements directs the medium into a neighbouring channel, the extraction pipes are connected to sections of the first channel between the corresponding closure element and the median plane in the vicinity of the corresponding closure element, and between the lower extraction pipe and the corresponding closure element there is a drain pipe for draining condensate from the lower after-cooler.

In a different preferred embodiment each of the finned tubes is divided into a main condenser and at least one after-cooler by at least one separation wall connected to the side walls, the at least one separation wall extending from the first closing surface towards the centre of the finned tube at an acute angle to the first closing surface, wherein the connection of the at least one extraction pipe to the at least one after-cooler is in the vicinity of a joining between the at least one separation wall and the first closing surface. Preferably, in each of the finned tubes there is one after-cooler formed by one separation wall extending towards the lower header, or there is a pair of symmetrical arranged after-coolers with a pair of separation walls arranged symmetrically to a median plane bisecting the finned tubes perpendicularly to the side walls, in which case between the lower extraction pipe and the corresponding joining there is a drain pipe for draining condensate from the lower after-cooler.

In a further preferred embodiment each of the finned tubes has multiple separation walls, wherein in the direction of the cooling air flow the first separation wall is formed without breakthroughs and the remaining separation walls are formed with breakthroughs, thereby separating each of the finned tubes into a first channel and a remaining part, and there is a first extraction pipe connected to the first channel substantially at a middle portion of the first closing surface and a second extraction pipe connected to the remaining part substantially at a middle portion of the first separation wall.

The condenser according to the invention preferably has a first valve for controlling the flow of the vaporous medium into the lower header and a second valve for controlling the flow of the vaporous medium into the upper header. Furthermore, the condenser preferably also comprises means for driving the cooling air flow to the finned tubes and louvres arranged between the driving means and the finned tubes for controlling the cooling air flow.

BRIEF DESCRIPTION OF DRAWINGS

The invention will hereinafter be described on the basis of preferred embodiments depicted by the drawings, where.

BEST MODES FOR CARRYING OUT THE INVENTION

Figures 1, 2:
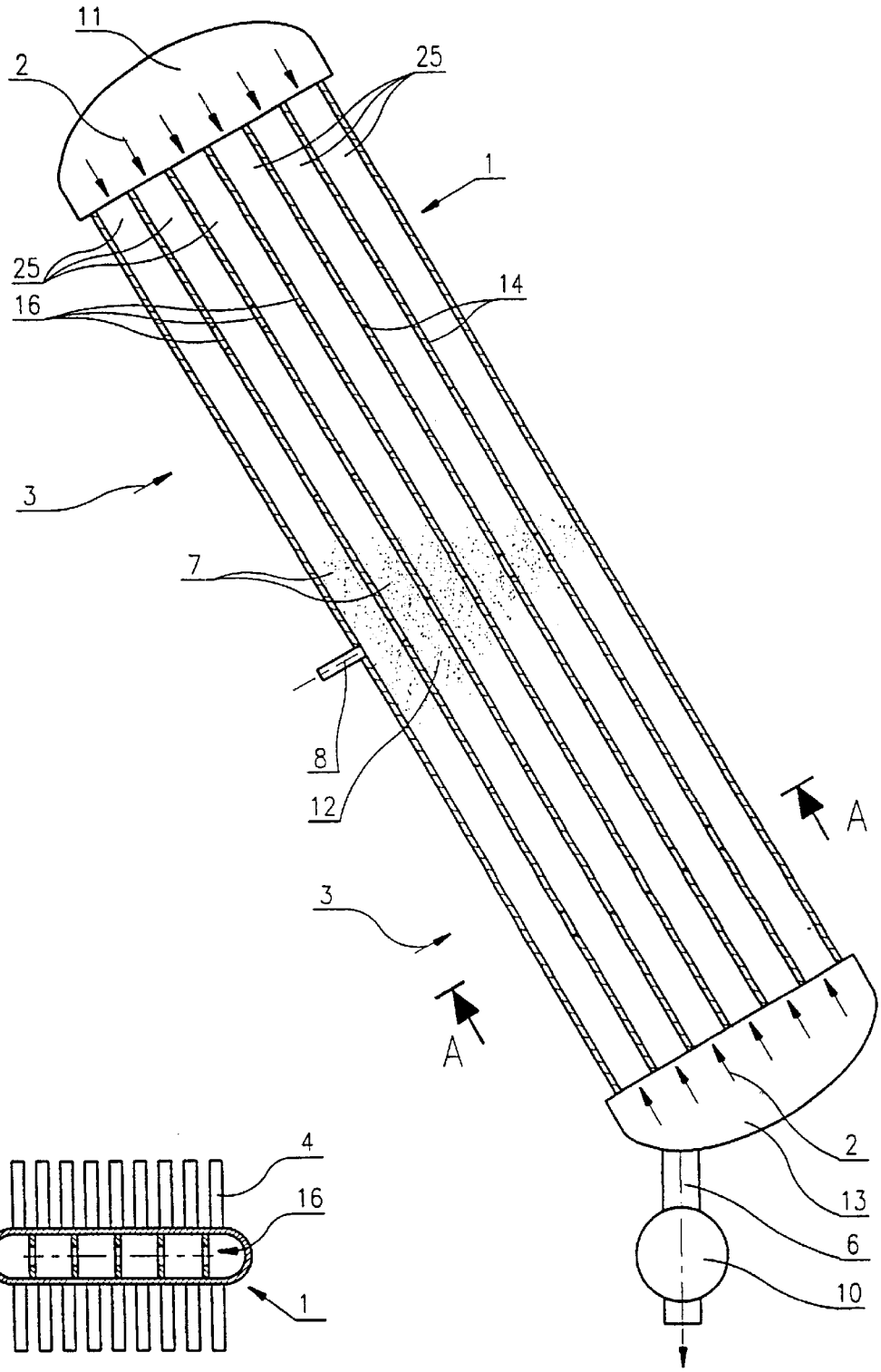
FIG. 1 is a cross-sectional view of a part of a preferred embodiment fitted with finned tubes having internal separation walls, internal channels and breakthroughs on the separation walls.
FIG. 2 is a cross sectional view of the finned tube in FIG. 1 taken along plane A—A.

In FIG. 1 an air-cooled condenser is shown comprising an upper header 11, a lower header 13 and spaced finned tubes 1 connected in parallel between the upper header 11 and the lower header 13 and cooled by a cooling air flow 3. Condensate is drained from the lower header 13 via a drain pipe 6 by a pump 10.

In FIG. 1 one of the finned tubes 1 is shown in longitudinal cross-section. The transversal cross section of the finned tube 1 taken along plane A—A is depicted in FIG. 2. It can be seen that the finned tube has two parallel substantially flat side walls arranged in parallel to the cooling air flow 3 and opposite arched closing surfaces connecting the side walls. The finned tube 1 also has longitudinal separation walls 14 connected to the side walls and dividing the inner space of the finned tubes 1 into longitudinal parallel channels 25. In the separation walls 14 there are breakthroughs 16 for allowing the flow of the medium between neighbouring channels 25.In the depicted embodiment the breakthroughs 16 are formed substantially equally spaced in the separation walls 14. The finned tube 1 in FIGS. 1 and 2 is designed substantially symmetrically to a median plane bisecting the finned tube 1 perpendicularly to the side walls. On the side walls of finned tube 1 outer fins 4 are arranged.

The most important difference to the known solutions described earlier is that the lower header 13 is also used for distributing the steam to the finned tubes 1,so that the steam is fed into the finned tubes 1 through both the upper and lower headers 11, 13. The flow of the steam is depicted by arrows 2. For the purpose of extraction of the non-condensible gases, mainly air, an extraction pipe 8 is connected to the finned tube 1. As a result of the geometric and flow symmetry, this solution ensures that the so-called congestion area is developed at the median plane of the finned tube 1, in particular near to the closing surface facing the cooling air flow 3, i. e. in the first channel(s) 25. That is why the extraction pipe 8 is arranged at the median plane at the closing surface facing the cooling air flow 3.

To eliminate unbalanced flow and to ensure free removal of the air, the second, third etc. channels 25 are connected by breakthroughs 16. The first channel receives the coldest cooling air, so the greatest quantity of steam is condensed in the first channel 25, and as a consequence, the largest pressure drop is in the first channel 25. The cooling of the successive channels 25 towards the interior of the tube decreases gradually, as the cooling air flow 3 warms up, so the pressure drop decreases in them. The pressure difference between the channels 25 drives a part of the steam into the first channel 25 through the breakthroughs 16, which in turn carries the air. In this way in the vicinity of extraction pipe 8 a steam-air mixture 7 of high air concentration is concentrated and practically an integrated after-cooler 12 is developed there.

The advantages of the above air-cooled condenser with finned tubes fed from both headers are the following.

The inlet cross section available to the steam is twice as large, and at the same time the path to be travelled by the steam drops to one half. As the pressure drop in the finned tubes is quadratically proportional to the steam velocity, and it is inversely proportional to the length of the path to be travelled, the pressure drop in the finned tubes is decreased to one-eighth. So the temperature difference and thus the efficiency of the condenser will be the highest possible.

The temperature of the condensate collected in the lower header 13 is identical with the saturation temperature associated with the pressure of the entering steam, that is there is no undercooling. This is advantageous because for pre-heating the higher temperature condensate less steam must be taken away from the steam turbine, which results in an efficiency improvement.

Due to the low inlet steam velocity, the phenomenon of condensate hold up on the inner surface of the finned tubes does not occur, i. e. there is less frost risk.

As a result of the flow symmetry re-circulation generated due to the asymmetry is prevented, so the shift of the congestion point is also prevented.

Figure 3:
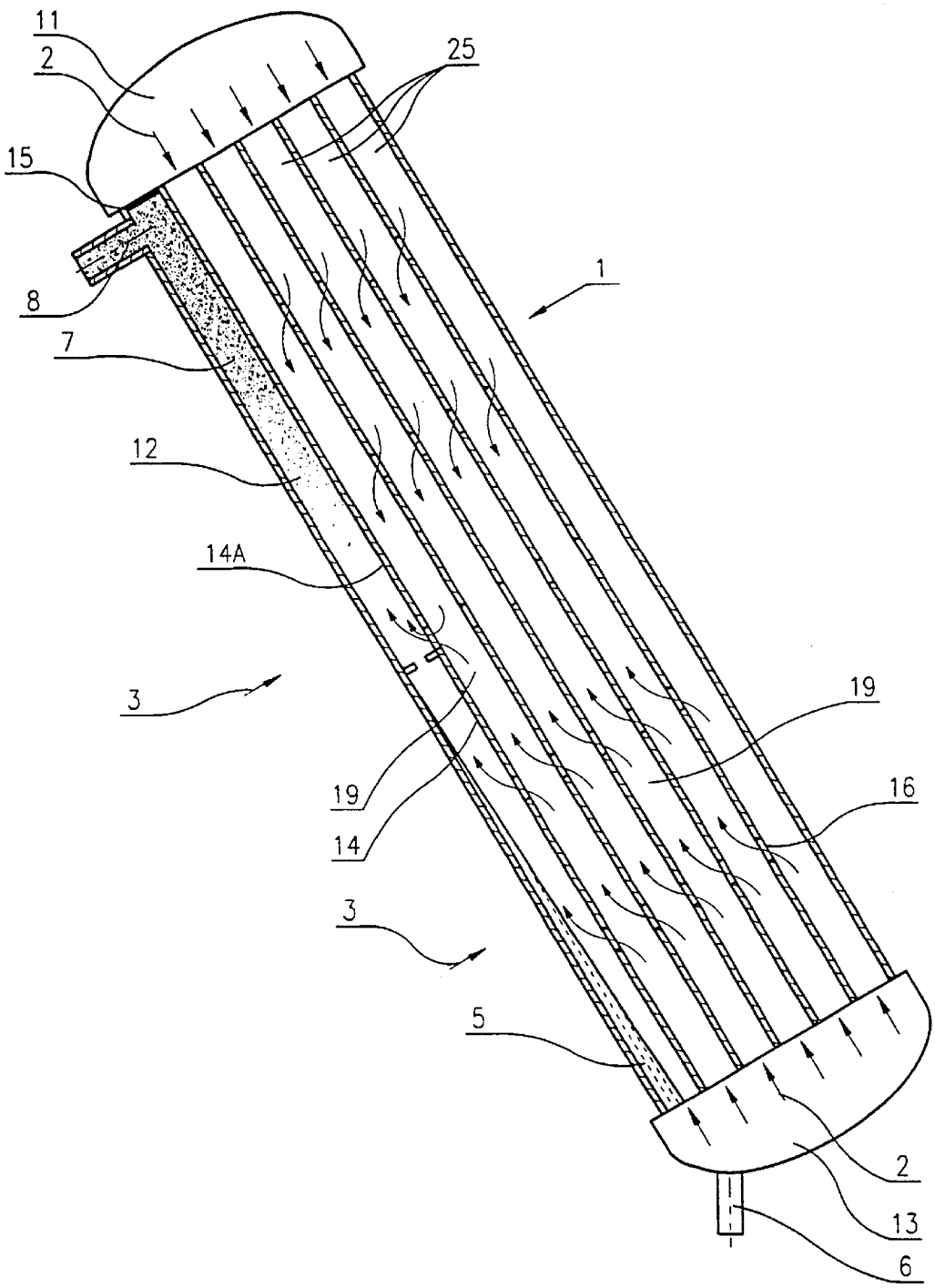
FIG. 3 is a cross-sectional view of another preferred embodiment of the condenser according to the invention.

Another possible embodiment is shown in FIG. 3, where a counterflow integrated after-cooler 12 is separated from a main condenser 19 of the finned tube 1 in an upper section of the first channel 25 in the direction of the air flow 3. The after-cooler 12 is separated by a closure element 15 arranged at an upper end of the first channel 25 and by an adjoining continuous portion of a separation wail 14A of the first channel 25. The extraction pipe 8 is connected to the first channel 25 in the vicinity of the closure element 15.

The advantage of this embodiment is that it extracts quite a significant part of the steam from the main condenser 19, thereby ensuring a flow of determined direction and velocity in the direction of air extraction, depicted by arrows. The condensate 5 flows downwards in a counterflow in after-cooler 12, against the flowing steam-air mixture 7.

Figure 14:
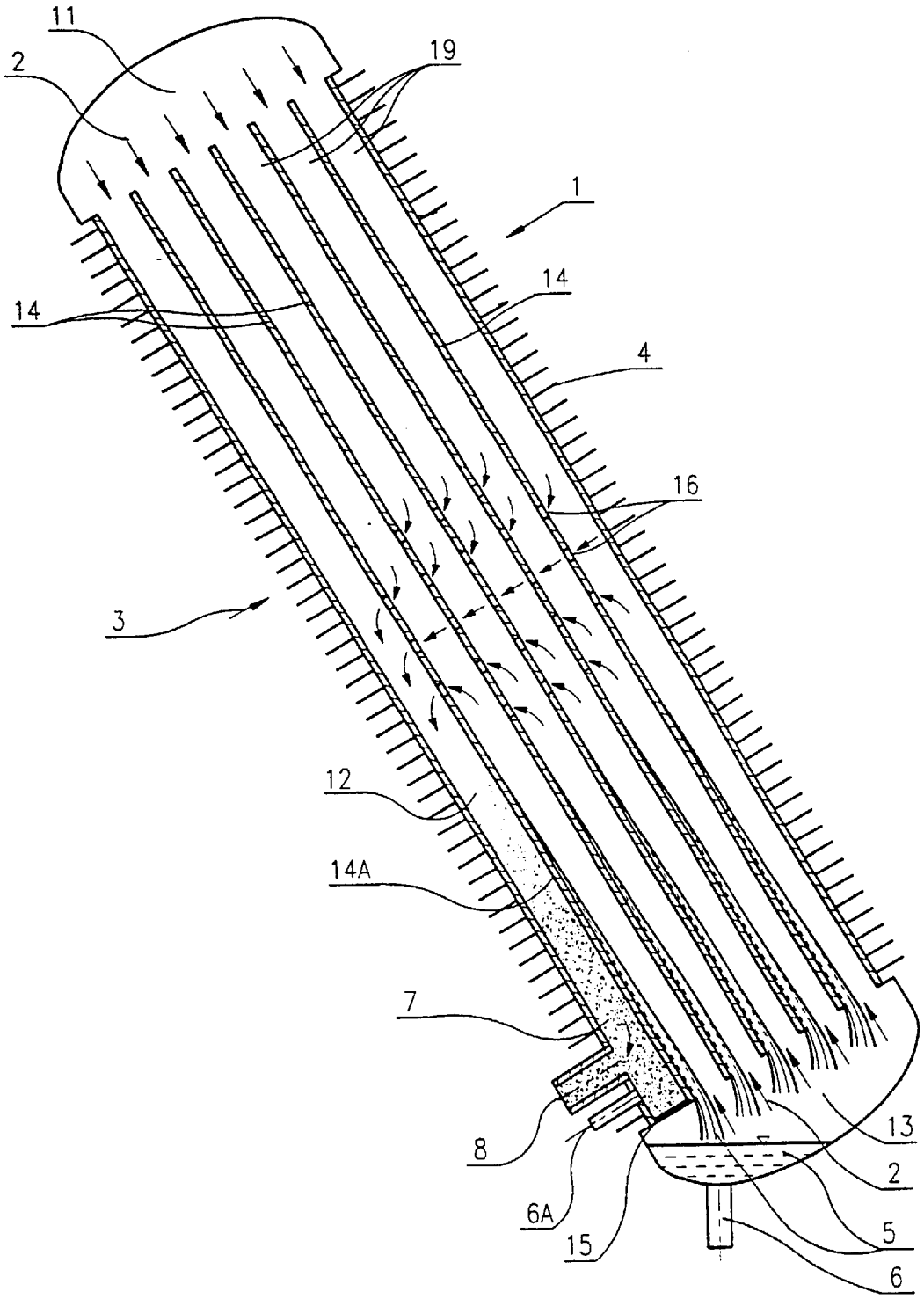
FIG. 14 is another preferred embodiment in cross-sectional view.
Figure 15:
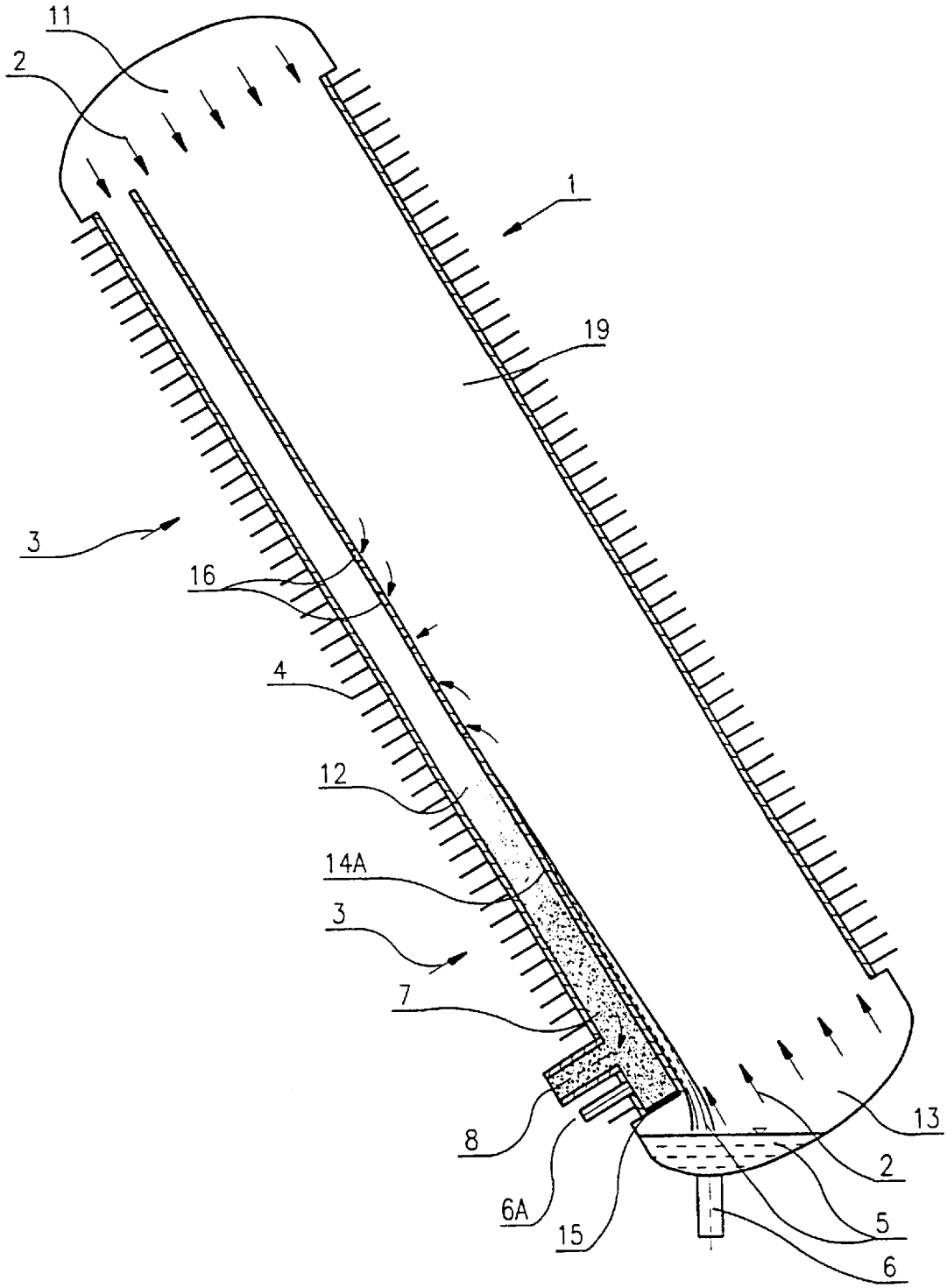
FIG. 15 is a further preferred embodiment in cross-sectional view.

Under cold climatic conditions when this is justified by the frost risk, after-cooler 12 and extraction pipe 8 can be fitted at the lower header 13 in the finned tubes 1. This is depicted in FIGS. 14 and 15. Although in this way the advantage of a counterflow after-cooler is lost—namely that it pre-heats the condensate—the frost risk that could be caused by condensate hold up can be avoided. At the bottom of the after-cooler 12 so developed the condensate 5 will be undercooled, but this does not represent a freezing risk because the separation wall 14A warms up the condensate from the second channel of the finned tube 1, preventing its freezing. In this case it is advisable to arrange the breakthrough(s) 16 in separation wall 14A at the middle of the finned tube 1. In this embodiments between the extraction pipe 8 and the closure element 15 there is a further drain pipe 6A for draining condensate 5 from the after-cooler 12.

Figure 4:
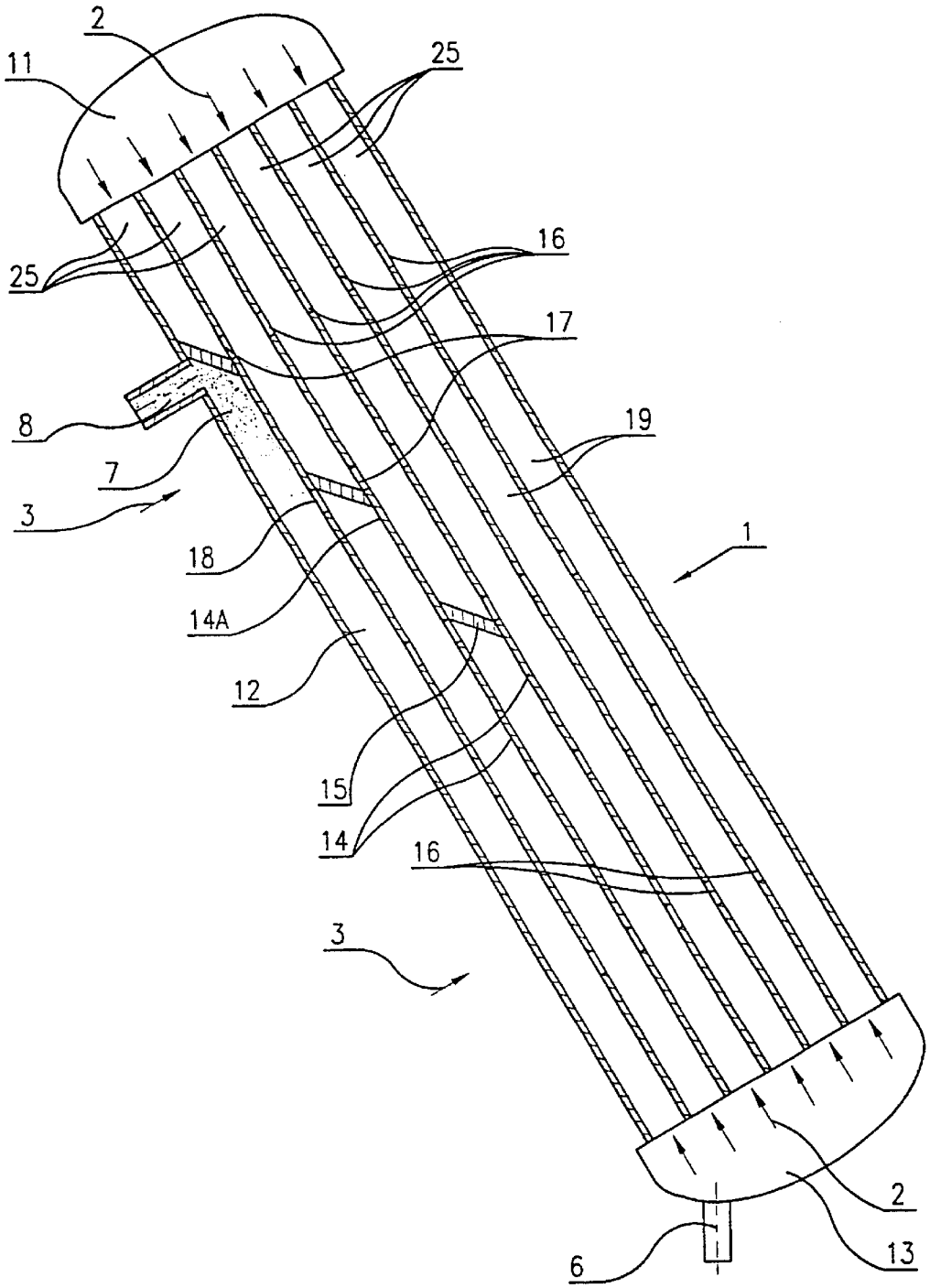
FIG. 4 is a cross-sectional view of a further preferred embodiment of the condenser according to the invention.

A similar embodiment is shown by FIG. 4, where after-cooler 12 is of a stepwise design. In the finned tube 1 there are multiple separation walls 14, 14A, and the finned tube 1 is divided by closure elements 15 formed in the channels 25 and by further breakthroughs 17, 18 formed in the separation walls 14 adjacent the closure elements 15 into a main condenser 19 and the after-cooler 12, conducting the medium from the main condenser 19 to the extraction pipe 8. There are no breakthroughs in separation walls 14A. The closure elements 15 are disposed in a distance from the upper header 11 so that said distance successively increases starting from the first channel 25 in the direction of the cooling air flow 3 towards the interior of the finned tube 1. The extraction pipe 8 is connected to a section of the first channel 25 between its closure element 15 and the lower header 13 in the vicinity of the closure element 15.

The number of steps of the after-cooler 12 is arbitrary, and so there could be one step only, in which case only one closure element 15 is fitted in the first channel 25. It is also possible to design the after-cooler 12 in a manner that it is arranged from the second channel 25 and the extraction pipe 8 is connected to the second channel 25.

Figure 5:
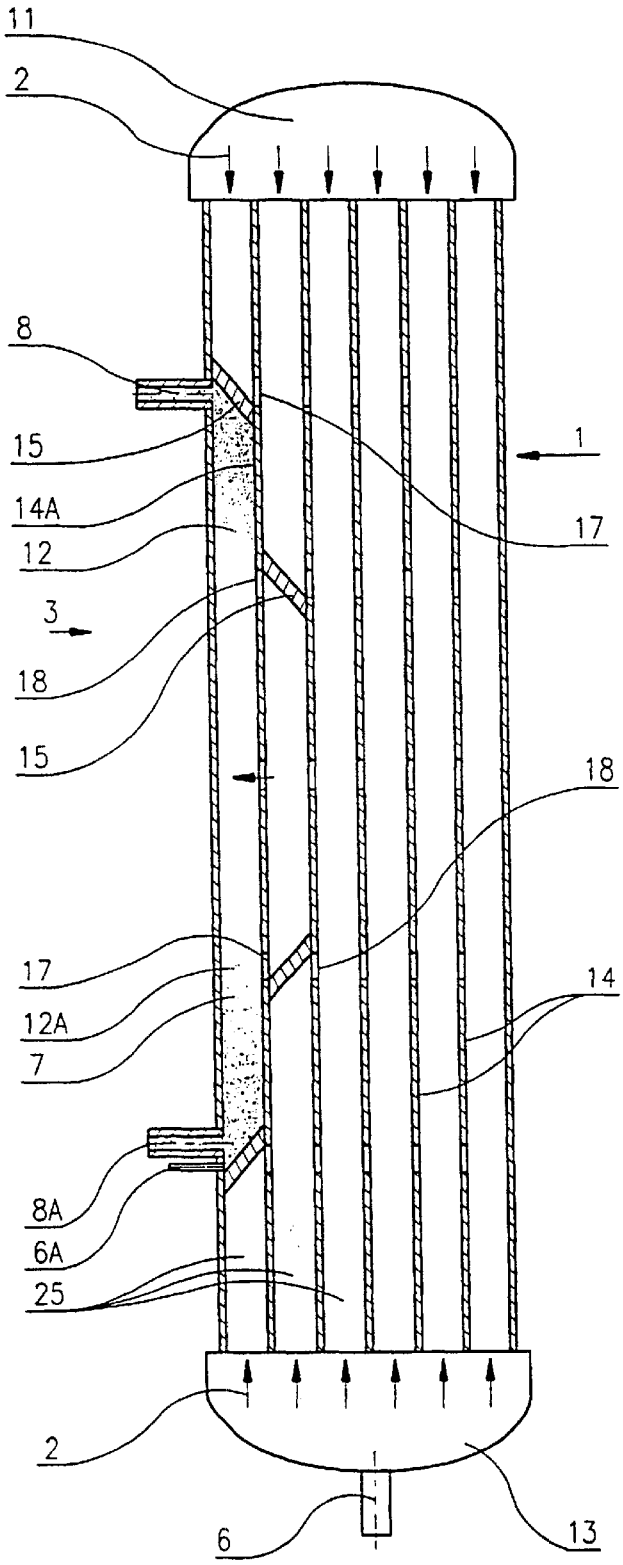
FIG. 5 is a cross-sectional view of another preferred embodiment of the condenser according to the invention having finned tubes with two after-coolers.

The embodiment in FIG. 5 includes a pair of stepwise after-coolers 12, 12A and two corresponding extraction pipes 8, 8A arranged symmetrically to a median plane of the finned tube 1. In the finned tube 1 two pairs of the closure elements 15 are disposed symmetrically to and in a distance from the median plane so that said distance successively decreases starting from a first channel 25 in the direction of the cooling air flow 3 towards the interior of the finned tube 1. The extraction pipes 8, 8A are connected to sections of the first channel 25 between the corresponding closure element 15 and the median plane in the vicinity of the corresponding closure element 15 and between the lower extraction pipe 8A and the corresponding closure element 15 there is a further drain pipe 6A for draining condensate 5 from the lower after-cooler 12A.

Figure 6:
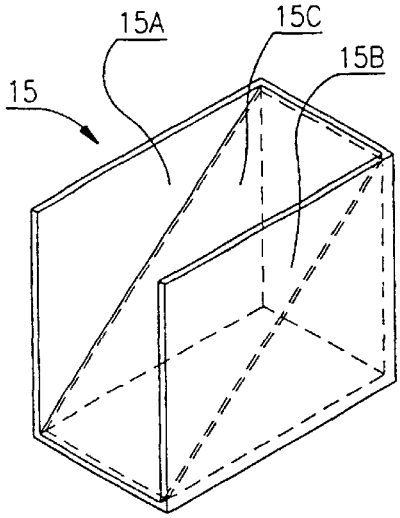
FIG. 6 is an enlarged perspective view of one closure element of the embodiment in FIG. 5.

In FIG. 6 one of the closure elements 15 used in the embodiment in FIG. 5 is depicted. It consists of two side plates 15A, 15B and a sloping middle plate 15C connecting the side plates 15A, 15B.

Figure 7:
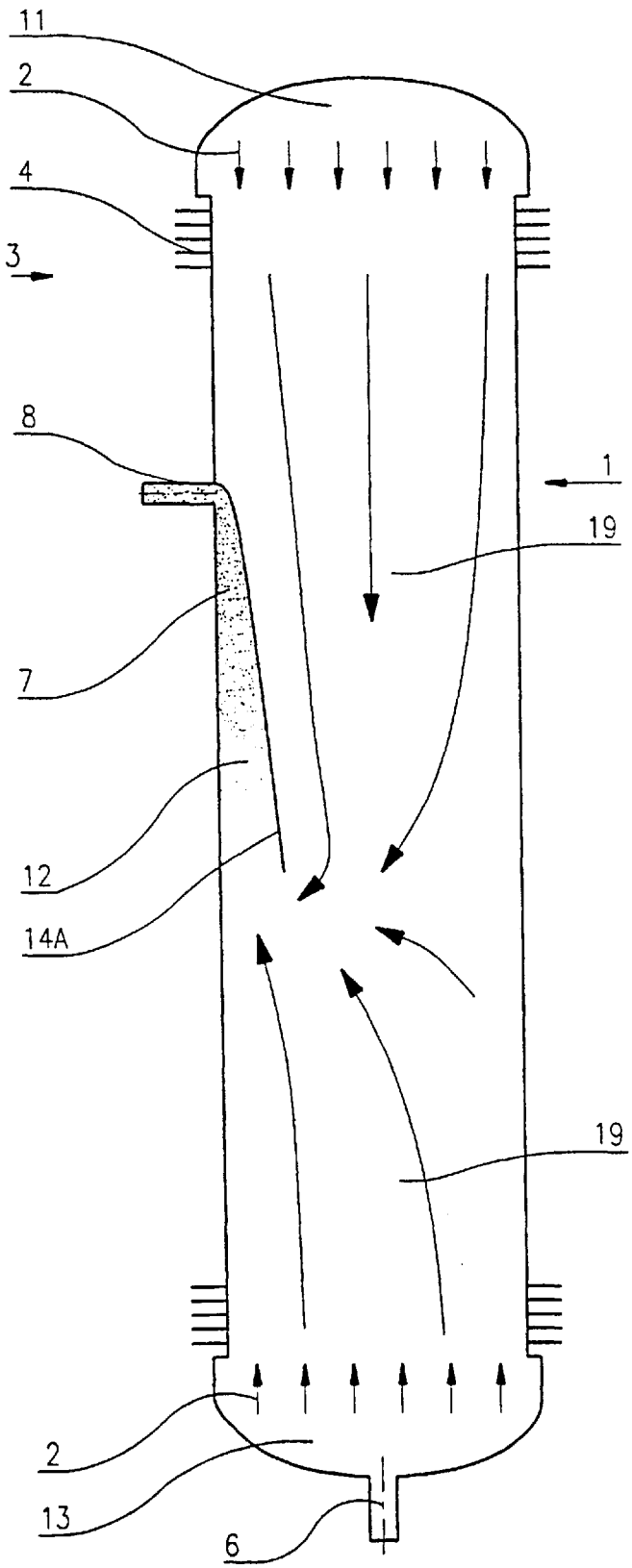
FIG. 7 is a cross-sectional view of another preferred embodiment having finned tubes without internal longitudinal channels.

The example of an air-cooled condenser having so-called single channel finned tubes 1 is shown in FIG. 7. In this embodiment, the entrance of the after-cooler 12 is located around the middle of the finned tube 1 so as to provide sufficient space for the condensation of the steam entering from the lower header 13. The finned tube is divided into the main condenser 19 and the after-cooler 12 by one separation wall 14A connected to the side walls. The separation wall 14A extends from the closing surface facing the cooling air flow 3 towards the lower header 13 at an acute angle to the closing surface.

Figure 8:
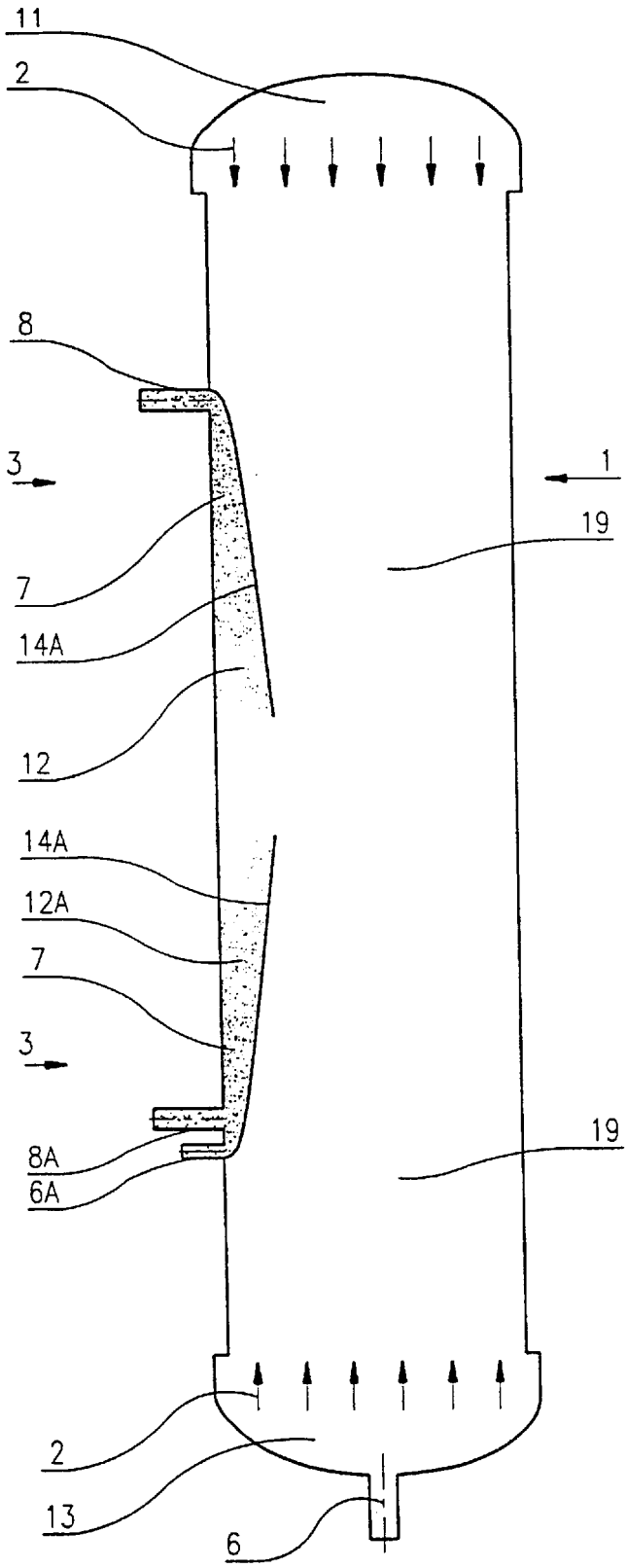
FIG. 8 is a cross-sectional view of a further preferred embodiment having finned tubes with two after-coolers.

FIG. 8 again shows an air-cooled condenser having single channel finned tubes 1, with a symmetric after-cooler arrangement similar to FIG. 5. The advantage of this solution is that both main condensers 19 and both after-coolers 12, 12A provide a narrowing cross section in the direction of the flow of the steam and, as a result, a determined flow velocity for the steam-air mixture 7.

Figure 9:
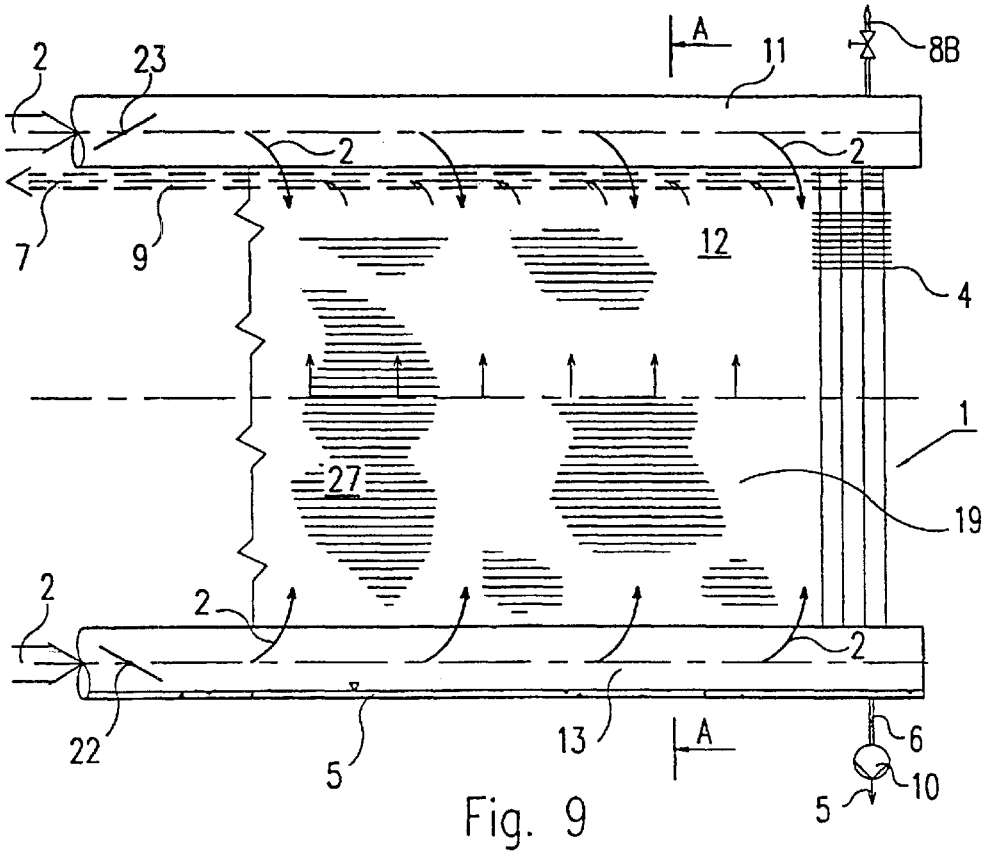
FIG. 9 is a side view of an air-cooled condenser fitted with finned tubes according to FIG. 3.
Figure 10:
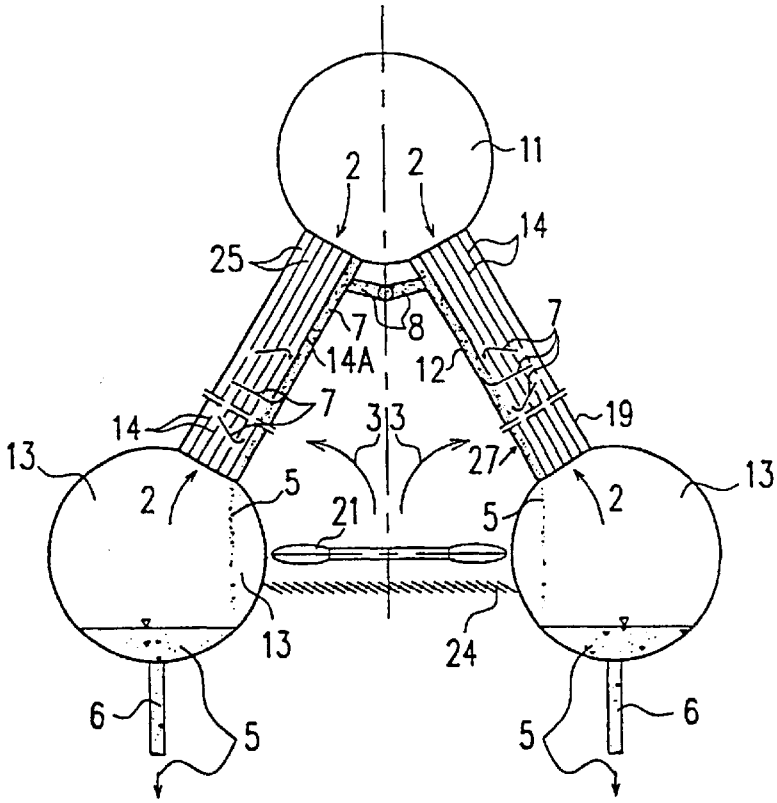
FIG. 10 is an enlarged, partly broken cross sectional view of the air-cooled condenser in FIG. 9 taken along plane A—A.
Figure 11:
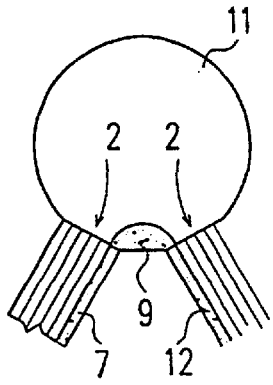
FIG. 11 is another embodiment of the air extraction in the air-cooled condenser in FIG. 9.

FIGS. 9 and 10 show a side view and a cross sectional view of an air-cooled condenser, respectively, wherein the air-cooled condenser has finned tubes 1 according to FIG. 3, of which only a few are shown on the right. In FIG. 10 the cross section is broken and the depicted parts are enlarged. The air-cooled condenser comprises two bundles 27 of a large number of finned tubes 1 connected in parallel. The two bundles 27 include an angle with each-other and each of them connects a common upper header 11 with a respective lower header 13. FIG. 11 shows an embodiment in which an air extraction pipeline 9 connected to the after-coolers 12 is located in the upper header 11.

As there are six channels 25 in the finned tubes 1, and in the upper half of the first channel is the after-cooler 12 arranged, in the upper half of the finned tubes there is a 1/6 part after-cooler and 5/6 part main condenser. In the lower half 100% of the finned tubes 1 is main condenser 19. In FIG. 9 thick arrows show the flow direction of the steam, while the flow of the steam-air mixture 7 in after-cooler 12 and in air extraction pipeline 9 is shown by thin arrows. In the lower header 13 at the bottom the condensate is collected and drained via drain pipe 6 by pump 10 to a steam generating equipment not shown.

Very favourable opportunities for avoiding frost risk in winter are provided by valves 22 and 23 shown in FIG. 9 which are preferably butterfly valves. In cold weather, the start-up of the air-cooled condenser can be made safely in a way that the steam is only introduced from the lower headers 13, which gradually heats up the cold heat exchange surface by flowing against the condensate flowing down, while the condensate is always exposed to a heated up finned tube surface. To this end, at a winter start-up, valve 22 is kept open, and valve 23 is kept closed. In this operating state, the non-condensible air is removed through air extraction pipe 8B.

This system also ensures the preventing of the condensate hold up in an extremely cold weather when in spite of the large inlet cross sections, the velocity of steam entering from the lover header 13 could be higher than desired, by keeping butterfly valve 22 closed and butterfly valve 23 open. The installation of these two valves 22, 23, by means of a limited throttling in one of them, also enables preventing the shifting of the congestion point mentioned earlier or provides for reducing this effect.

Figure 12:
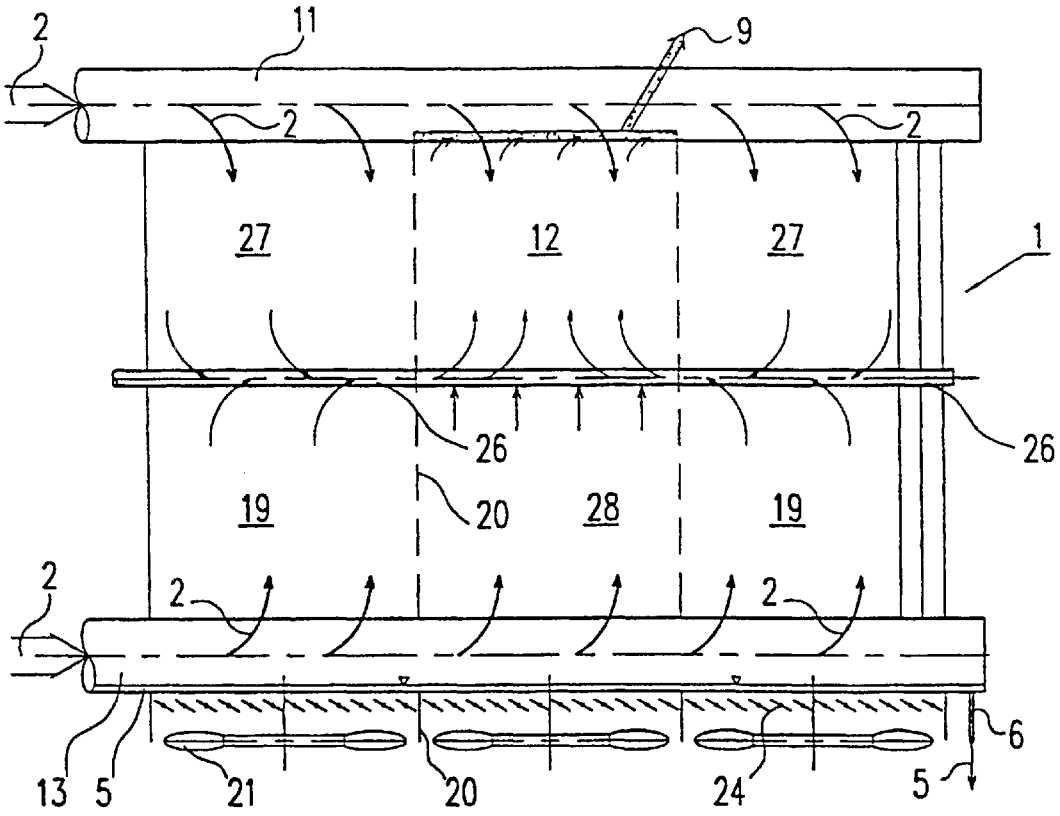
FIG. 12 is a side view of an air-cooled condenser having different finned tubes.

A combination of the embodiments shown in FIGS. 1 and 3 is depicted in FIG. 12, which is a side view of an air-cooled condenser according to the invention. The advantage of this arrangement is that the bundle 28 of finned tubes located in the middle, which includes finned tubes with after-coolers according to FIG. 3, reduces to the minimum the steam content of the steam-air mixture 7 extracted from the other bundles 27 of finned tubes according to FIG. 1 The steam-air mixture 7 extracted from bundles 27 is transferred via a common transfer pipe 26 to each of the first channels 25 of the finned tubes 1 in bundle 28 substantially at middle portions of the first channels 25. The bundle 28 of finned tubes in the middle may be separated by separating walls 20 from the other bundles 27. In this way both types of bundles 27, 28 can have separate cooling air flow controlling devices, for example, louver 24 and/or fan 21, which could be advantageous under winter operating conditions.

Figure 13:
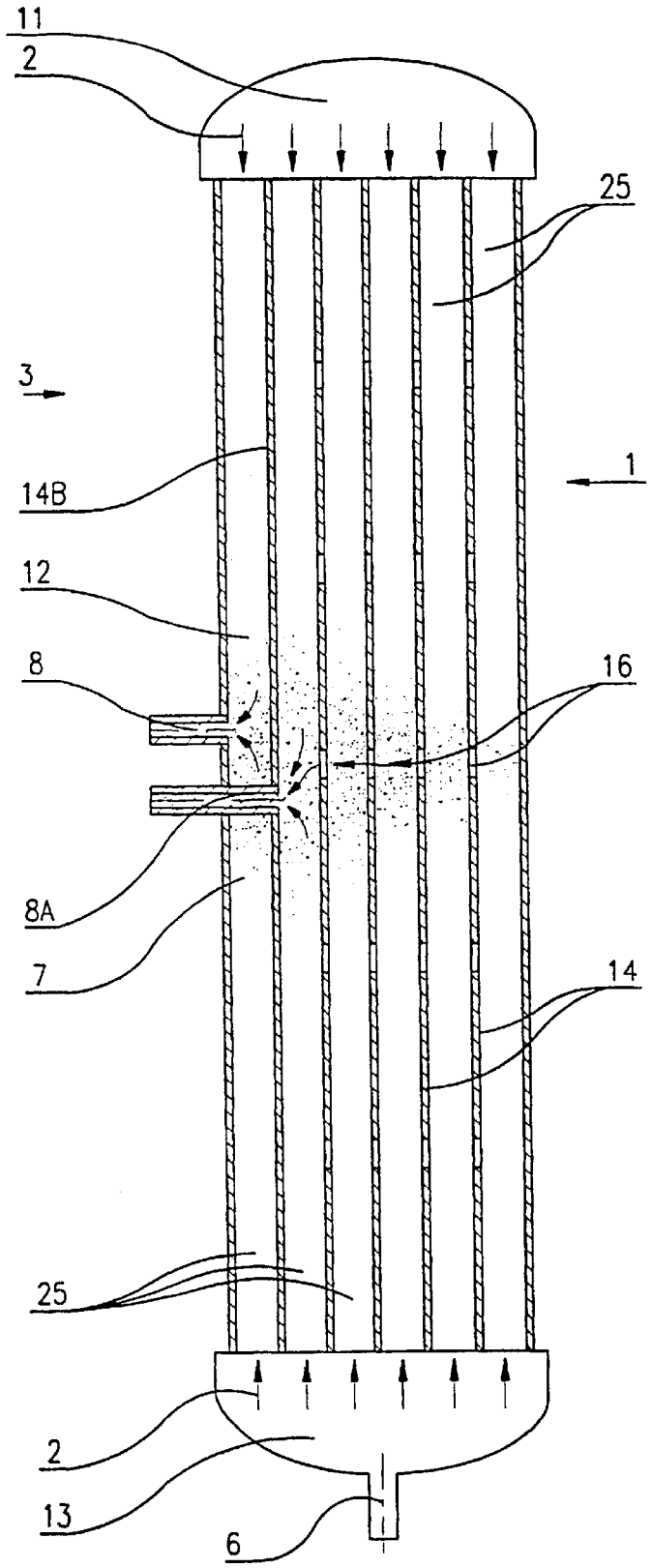
FIG. 13 is a cross-sectional view of a further preferred embodiment having two air extraction pipes.

FIG. 13 shows a cross sectional view of an air cooled condenser having finned tubes 1 with multiple separation walls 14, 14B. This embodiment is similar to that in FIG. 1 but in the direction of the cooling air flow 3 the first separation wall 14B is formed without breakthroughs and the remaining separation walls 14 are formed with breakthroughs 16, thereby each of the finned tubes 1 is separated into a first channel 25 and a remaining part. A first extraction pipe 8 is connected to the first channel 25 substantially at a middle portion thereof and a second extraction pipe 8A is connected to the remaining part substantially at a middle portion of the first separation wall 14B. In a winter operation, by controlling a throttling in extraction pipe 8A, an air pocket can be created in the second and next channels 25, and in this way the effective heat transfer surface and thus the efficiency can be reduced and arbitrarily controlled. Through extraction pipe 8, all the air can be removed from the first channel 25. The result will be that in spite of the air pocket accumulated in the second and the next channels 25 there will be no frost risk, because a heated up cooling air flow 3 is transferred to the second channel 25. The shape of the air pocket created is shown by small dots. This embodiment—when this is required by excessively cold climatic conditions—may also be implemented by connecting the first two separated channels 25 jointly to extraction pipe 8, and the others with separation walls with breakthroughs to extraction pipe 8A. This solution is especially advantageous in the case of natural draught cooling towers, because it allows a very simple performance regulation without having to use costly louvers.

The description of physical processes and of the prior art apply to power plant steam condensers and to condensing steam, but of course the invention is not restricted to this type of condensers: they can also be used as applicable in other places and for other vaporous media where air-cooled condensers are required.

It will be evident to those skilled in the art that the above disclosure is exemplary only and that various other alterative, adaptations and modifications may be made within the scope of the present invention as defined by the following claims.

| List of reference signs | |
|---|---|
| 1 | finned tube |
| 2 | arrows |
| 3 | cooling air flow |
| 4 | fins |
| 5 | condensate |
| 6 | drain pipe |
| 6A | drain pipe |
| 7 | steam-air mixture |
| 8 | extraction pipe |
| 8A | extraction pipe |
| 8B | extraction pipe |
| 9 | air extraction pipeline |
| 10 | pump |
| 11 | upper header |
| 12 | after-cooler |
| 12A | after-cooler |
| 13 | lower header |
| 14 | separation wall |
| 14A | separation wall |
| 14B | separation wall |
| 15 | closure element |
| 15A | plate |
| 15B | plate |
| 15C | plate |
| 16 | breakthroughs |
| 17 | breakthroughs |
| 18 | breakthroughs |
| 19 | main condenser |
| 20 | separating wall |
| 21 | fan |
| 22 | valve |
| 23 | valve |
| 24 | louvers |
| 25 | channel |
| 26 | transfer pipe |
| 27 | bundle |
| 28 | bundle |

What is claimed is:

1. An air-cooled condenser comprising an upper header for distributing a vaporous medium to be condensed, a lower header for collecting condensate, spaced finned tubes with outer fins, said finned tubes being connected in parallel between the upper header and the lower header and cooled by a cooling air flow, means for draining the condensate from the lower header and extraction means for removing non-condensable gases from the condenser, wherein said lower header is also used for distributing the vaporous medium to the finned tubes, so that the vaporous medium is fed into the finned tubes through both the upper and lower headers, and the extraction means are connected to each of the finned tubes at its portion facing the cooling air flow.

2. The condenser according to claim 1 further comprising finned tubes each having two substantially flat side walls arranged generally in parallel to the cooling air flow, a first closing surface facing the cooling air flow and a second opposite closing surface, said side walls being connected by the first and second closing surfaces, and wherein said extraction means comprise at least one extraction pipe for each finned tube connected to the finned tube at the first closing surface.

3. The condenser according to claim 2, wherein the closing surfaces of the finned tubes are arched.

4. The condenser according to claim 2 further comprising finned tubes each having at least one longitudinal separation wall connected to the side walls and dividing the inner space of the finned tube into longitudinal parallel channels, and in said at least one separation wall there are breakthroughs for allowing the flow of the medium between neighboring channels.

5. The condenser according to claim 4, wherein said breakthroughs are formed substantially equally spaced in said at least one separation wall.

6. The condenser according to claim 4 further comprising finned tubes each designed substantially symmetrically to a median plane bisecting the finned tubes perpendicularly to the side walls, wherein one extraction pipe is connected to each of the finned tubes substantially at the median plane.

7. The condenser according to claim 4 further comprising finned tubes each having a separated after-cooler formed in a first channel in the direction of the cooling air flow, the after-cooler being separated by a closure element arranged at an end of the first channel and by an adjoining continuous portion of a separation wall of the first channel from remaining parts of the finned tube, wherein one extraction pipe is connected to each of said first channels in the vicinity of said closure element.

8. The condenser according to claim 7, wherein said closure element is arranged at the upper end of the first channel.

9. The condenser according to claim 7, wherein said closure element is arranged at the lower end of the first channel, and between the extraction pipe and the closure element there is a drain pipe for draining condensate from the after-cooler.

10. The condenser according to claim 4 further comprising a first part fitted with finned tubes each designed substantially symmetrically to a median plane bisecting the finned tubes perpendicularly to the side walls, and a second part fitted with finned tubes each having a separated after-cooler formed in a first channel in the direction of the air flow, said after-cooler being separated by a closure element arranged at an end of the first channel and by an adjoining continuous portion of a separation wall of the first channel from remaining parts of the finned tube, and wherein said first part one extraction pipe is connected to each of the finned tubes substantially at the median plane, in the second part one extraction pipe is connected to each of the first channels in the vicinity of said closure element, and the extraction pipes in the first part are connected via a common transfer pipe to each of the first channels of the finned tubes in said second part substantially at middle portions of the first channels.

11. The condenser according to claim 4 further comprising finned tubes each having multiple separation walls, each of the finned tubes is divided by closure elements formed in the channels and by further breakthroughs formed in the separation walls adjacent the closure elements into a main condenser and at least one after-cooler conducting the medium from the main condenser to the at least one extraction pipe.

12. The condenser according to claim 11, wherein there are one after-cooler and one extraction pipe in each of the finned tubes, each of the closure elements is disposed in a distance from the upper header so that said distance successively increases starting from a first channel in the direction of the cooling air flow towards the interior of the finned tube, said breakthroughs adjacent the closure elements directs the medium into a neighboring channel, and said extraction pipe is connected to a section of the first channel between its closure element and the lower header in the vicinity of said closure element.

13. The condenser according to claim 12, wherein starting from the first channel about half of the channels are provided with said closure elements.

14. The condenser according to claim 11, further comprising a pair of symmetrical arranged after-coolers and two corresponding extraction pipes in each of the finned tubes, wherein pairs of the closure elements are disposed symmetrically to and in a distance from a median plane of the finned tube so that said distance successively decreases starting from a first channel in the direction of the cooling air flow towards the interior of the finned tube, the breakthroughs adjacent the closure elements directs the medium into a neighboring channel, the extraction pipes are connected to sections of the first channel between the corresponding closure element and the median plane in the vicinity of the corresponding closure element, and between the lower extraction pipe and the corresponding closure element there is a drain pipe for draining condensate from the lower after-cooler.

15. The condenser according to claim 2 further comprising finned tubes divided into a main condenser and at least one after-cooler by at least one separation wall connected to the side walls, the at least one separation wall extending from the first closing surface towards the center of the finned tube at an acute angle to the first closing surface, and wherein the connection of the at least one extraction pipe to the at least one after-cooler is in the vicinity of a joining between the at least one separation wall and the first closing surface.

16. The condenser according to claim 15, wherein in each of the finned tubes there is one after-cooler formed by one separation wall extending towards the lower header.

17. The condenser according to claim 15, wherein in each of the finned tubes there is a pair of symmetrical arranged after-coolers with a pair of separation walls arranged symmetrically to a median plane bisecting the finned tubes perpendicularly to the side walls, and between the lower extraction pipe and the corresponding joining there is a drain pipe for draining condensate from the lower after-cooler.

18. The condenser according to claim 4 further comprising finned tubes each having multiple separation walls, and wherein in the direction of the cooling air flow the first separation wall formed without breakthroughs and the remaining separation walls are formed with breakthroughs, thereby separating each of the finned tubes into a first channel and a remaining part, and there is a first extraction pipe connected to the first channel substantially at a middle portion of the first closing surface and a second extraction pipe connected to said remaining part substantially at a middle portion of the first separation wall.

19. The condenser according to claim 1 further comprising a first valve for controlling the flow of the vaporous medium into the lower header and a second valve for controlling the flow of the vaporous medium into the upper header.

20. The condenser according to claim 1 further comprising means for driving the cooling air flow to the finned tubes and louvres arranged between the driving means and the finned tubes for controlling the cooling air flow.

* * * * *